US009644384B2

(12) United States Patent
Powell et al.

(10) Patent No.: US 9,644,384 B2
(45) Date of Patent: May 9, 2017

(54) BUCKLING RESTRAINED BRACE AND RELATED METHODS

(71) Applicant: Star Seismic, LLC, Park City, UT (US)

(72) Inventors: Steven D. Powell, Park City, UT (US); Timothy Nordstrom, Buckley, WA (US)

(73) Assignee: Star Seismic, LLC, Park City, UT (US)

( * ) Notice: Subject to any disclaimer, the term of this patent is extended or adjusted under 35 U.S.C. 154(b) by 0 days.

(21) Appl. No.: 14/620,980

(22) Filed: Feb. 12, 2015

(65) Prior Publication Data

US 2016/0237711 A1 Aug. 18, 2016

(51) Int. Cl.
*E04H 9/02* (2006.01)
*E04C 3/02* (2006.01)

(52) U.S. Cl.
CPC ..... *E04H 9/021* (2013.01); *E04C 2003/026* (2013.01)

(58) Field of Classification Search
CPC E04H 9/02; E04H 9/021; E04H 9/024; E04H 9/028; E04B 2001/2496; E04C 2003/026
USPC ..... 52/167.1, 167.3, 657, 656.9
See application file for complete search history.

(56) References Cited

U.S. PATENT DOCUMENTS 3,600,014 A 8/1971 Harris et al.
3,867,048 A * 2/1975 Endzweig ..... 403/252
4,371,143 A * 2/1983 Ishida et al. ..... 248/638
4,577,826 A * 3/1986 Bergstrom et al. ..... 248/638
5,904,066 A * 5/1999 Lehman ..... 269/266
6,192,647 B1 * 2/2001 Dahl ..... 403/300
6,244,577 B1 * 6/2001 Bucholtz ..... 267/136
6,530,182 B2 3/2003 Fanucci et al.
6,701,680 B2 3/2004 Fanucci et al.
6,826,874 B2 12/2004 Takeuchi et al.
7,174,680 B2 2/2007 Smelser
7,185,462 B1 3/2007 Smelser
7,188,452 B2 3/2007 Sridhara
7,225,588 B2 6/2007 Nakamura et al.
(Continued)

FOREIGN PATENT DOCUMENTS

WO 0222994 A1 3/2002

OTHER PUBLICATIONS

International Search Report for International Application No. PCT/US2015/033747, dated Oct. 28, 2015, 4 pages.
(Continued)

*Primary Examiner* — Theodore Adamos
(74) *Attorney, Agent, or Firm* — TraskBritt

(57) ABSTRACT

A buckling restrained brace includes a core rod, a buckling restraining tube concentrically surrounding at least a portion of a length of the core rod and configured to provide lateral support to the core rod to hinder buckling of the core rod upon compressive loading of the core rod, and an exterior support tube disposed concentrically surrounding at least a portion of a length of the buckling restraining tube. A plurality of spacers may be disposed between the buckling restraining tube and the exterior support tube at intervals along a length of the buckling restraining tube. The plurality of spacers may locate and support the buckling restraining tube within the exterior support tube.

20 Claims, 4 Drawing Sheets

(56) References Cited

U.S. PATENT DOCUMENTS

| | | | | |
|---|---|---|---|---|
| 7,243,467 | B2 * | 7/2007 | Peccoraro | 52/202 |
| 7,284,358 | B2 | 10/2007 | Smelser | |
| 7,305,799 | B2 | 12/2007 | Smelser et al. | |
| 7,461,481 | B2 | 12/2008 | Tsai | |
| 7,614,187 | B1 * | 11/2009 | Forbes | 52/202 |
| 7,707,788 | B2 | 5/2010 | Bystricky et al. | |
| 7,716,882 | B2 | 5/2010 | Smelser | |
| 8,146,300 | B2 | 4/2012 | Bystricky et al. | |
| 8,146,301 | B2 | 4/2012 | Bystricky et al. | |
| 8,590,258 | B2 | 11/2013 | Hinchman | |
| 8,677,699 | B2 * | 3/2014 | Tagawa | 52/167.8 |
| 8,998,182 | B2 * | 4/2015 | Kim et al. | 267/34 |
| 2001/0000840 | A1 | 5/2001 | Takeuchi et al. | |
| 2002/0066246 | A1 | 6/2002 | Leek | |
| 2002/0129568 | A1 * | 9/2002 | Oka | 52/167.3 |
| 2003/0183994 | A1 * | 10/2003 | Atwater | 267/71 |
| 2005/0087414 | A1 * | 4/2005 | Okimura et al. | 188/381 |
| 2005/0166487 | A1 | 8/2005 | Tsai | |
| 2005/0257490 | A1 * | 11/2005 | Pryor et al. | 52/736.3 |
| 2005/0274084 | A1 * | 12/2005 | Lin et al. | 52/167.1 |
| 2008/0098671 | A1 * | 5/2008 | Tsai | 52/167.6 |
| 2008/0229683 | A1 * | 9/2008 | Bystricky et al. | 52/167.3 |
| 2010/0313496 | A1 * | 12/2010 | Rahimian | 52/167.3 |
| 2011/0041424 | A1 * | 2/2011 | Jiang et al. | 52/167.1 |
| 2011/0041425 | A1 | 2/2011 | Bystricky et al. | |
| 2011/0232221 | A1 | 9/2011 | Tsai et al. | |
| 2013/0174501 | A1 * | 7/2013 | Michael et al. | 52/167.1 |
| 2014/0059950 | A1 | 3/2014 | Marinovic et al. | |
| 2014/0305048 | A1 * | 10/2014 | Ishii et al. | 52/167.1 |
| 2014/0311059 | A1 * | 10/2014 | Pryor et al. | 52/167.3 |

OTHER PUBLICATIONS

International Written Opinion for International Application No. PCT/US2015/033747, dated Oct. 28, 2015, 5 pages.

* cited by examiner

BUCKLING RESTRAINED BRACE AND RELATED METHODS

TECHNICAL FIELD

Embodiments of the present disclosure relate to buckling restrained braces for building construction.

BACKGROUND

In many areas of the world, large buildings and other structures may periodically be subjected to seismic or other loads (e.g., earthquakes, wind, weather related events, explosive blasts). In order to prevent structures from being damaged by such loads, particularly the displacements that follow the application of seismic loads to structures, or to at least reduce the amount of damage that loading may cause to such structures, various devices have been developed to absorb such displacements to reduce the loading experienced by other elements of the structure.

One such device is commonly referred to as a "buckling restrained brace." A buckling restrained brace may include an elongate yielding core element connected at two ends to a building frame, e.g., diagonally across a rectangular "bay" formed by two horizontal frame members and two vertical frame members. Plastic deformation of the yielding core element under applied forces can absorb a significant amount of energy and may mitigate or prevent damage to other elements of the building structure. The yielding core element is typically surrounded by a sleeve configured to allow the core element to lengthen in response to applied tensile forces, while hindering or preventing the yielding core element from buckling under compressive forces by providing the yielding core with lateral support.

In many buckling restrained braces, the sleeve includes a metal shell within which an annular layer of grout or cement is formed. The grout or cement material may be separated from the yielding core by a layer of, e.g., polymer material or by a small gap (i.e., void). For example, a buckling restrained brace featuring such an arrangement is described in U.S. Pat. No. 7,188,452 to Sridhara, filed Mar. 11, 2003, and issued Mar. 13, 2007, the disclosure of which is incorporated herein in its entirety by this reference.

BRIEF SUMMARY

In one aspect of the disclosure, a buckling restrained brace includes a core rod, a buckling restraining tube concentrically surrounding at least a portion of a length of the core rod and configured to provide lateral support to the core rod to hinder buckling of the core rod upon compressive loading of the core rod, and an exterior support tube disposed concentrically surrounding at least a portion of a length of the buckling restraining tube. A plurality of spacers is disposed between the buckling restraining tube and the exterior support tube at intervals along a length of the buckling restraining tube. The spacers locate and support the buckling restraining tube within the exterior support tube.

In another aspect of the disclosure, a buckling restrained brace includes a core rod, an end plate assembly attached to an end of the core rod, and a buckling restraining tube concentrically surrounding at least a portion of a length of the core rod and configured to provide lateral support to the core rod to hinder buckling of the core rod upon compressive loading of the core rod. A sleeve member concentrically surrounds an end of the buckling restraining tube, the sleeve member affixed to the end plate assembly. A spring is disposed within the sleeve member, the spring located between and abutting the end of the buckling restraining tube and the end plate assembly of the buckling restrained brace.

In yet another aspect of the disclosure, a buckling restrained brace includes a core rod, an end plate assembly attached to an end of the core rod, and a buckling restraining tube concentrically surrounding a portion of a length of the core rod and configured to provide lateral support to the core rod to hinder buckling of the core rod upon compressive loading of the core rod. An exterior support tube concentrically surrounds at least a portion of a length of the buckling restraining tube. A sleeve member is disposed around a portion of the buckling restraining tube, and the sleeve member is affixed to the end plate assembly. The sleeve member is permitted to move axially relative to the exterior support tube and the buckling restraining tube when the core rod plastically deforms in response to an applied force.

BRIEF DESCRIPTION OF THE DRAWINGS

While the specification concludes with claims particularly pointing out and distinctly claiming what are regarded as embodiments of the disclosure, various features and advantages of disclosed embodiments may be more readily ascertained from the following description when read with reference to the accompanying drawings, in which:

DETAILED DESCRIPTION

The illustrations presented herein are not actual views of any particular device, but are merely idealized representations employed to describe embodiments of the present disclosure. Additionally, elements common between figures may retain the same numerical designation.

Figure 1:
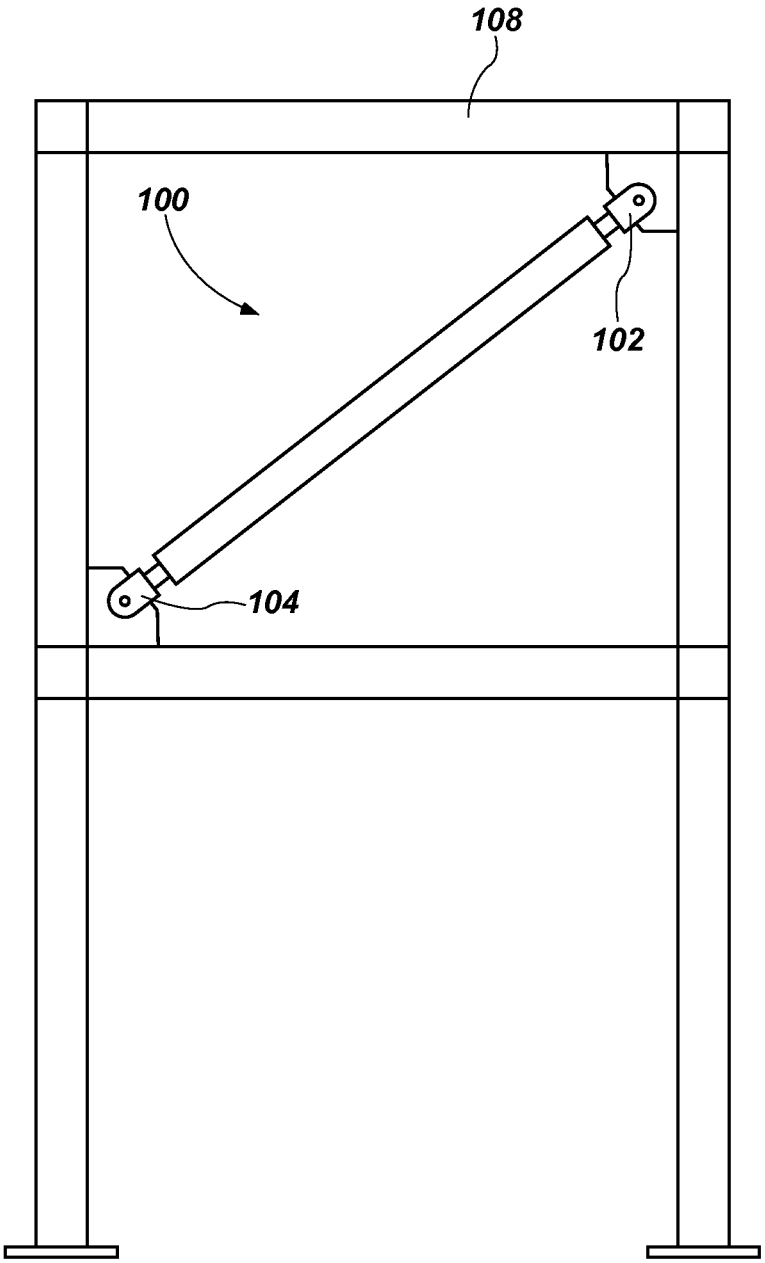
FIG. 1 is an elevation view of an embodiment of a building frame and a buckling restrained brace according to the disclosure.

Referring to FIG. 1, a buckling restrained brace 100 may be pinned or otherwise connected to a building frame 108 at two end plate assemblies 102, 104. In some embodiments, the buckling restrained brace 100 may be configured to provide diagonal bracing to reinforce the building frame 108. For example, the buckling restrained brace 100 may be connected between opposite corners of (i.e., diagonally across) a substantially rectilinear portion (e.g., a "bay") of the building frame 108. Upon occurrence of a seismic event (e.g., earthquake, explosive blast, etc.) or other application of shear force (e.g., wind) to the building frame 108, a component of the buckling restrained brace 100 may plastically deform to absorb force that could otherwise cause failure of the building frame 108.

Figure 2:
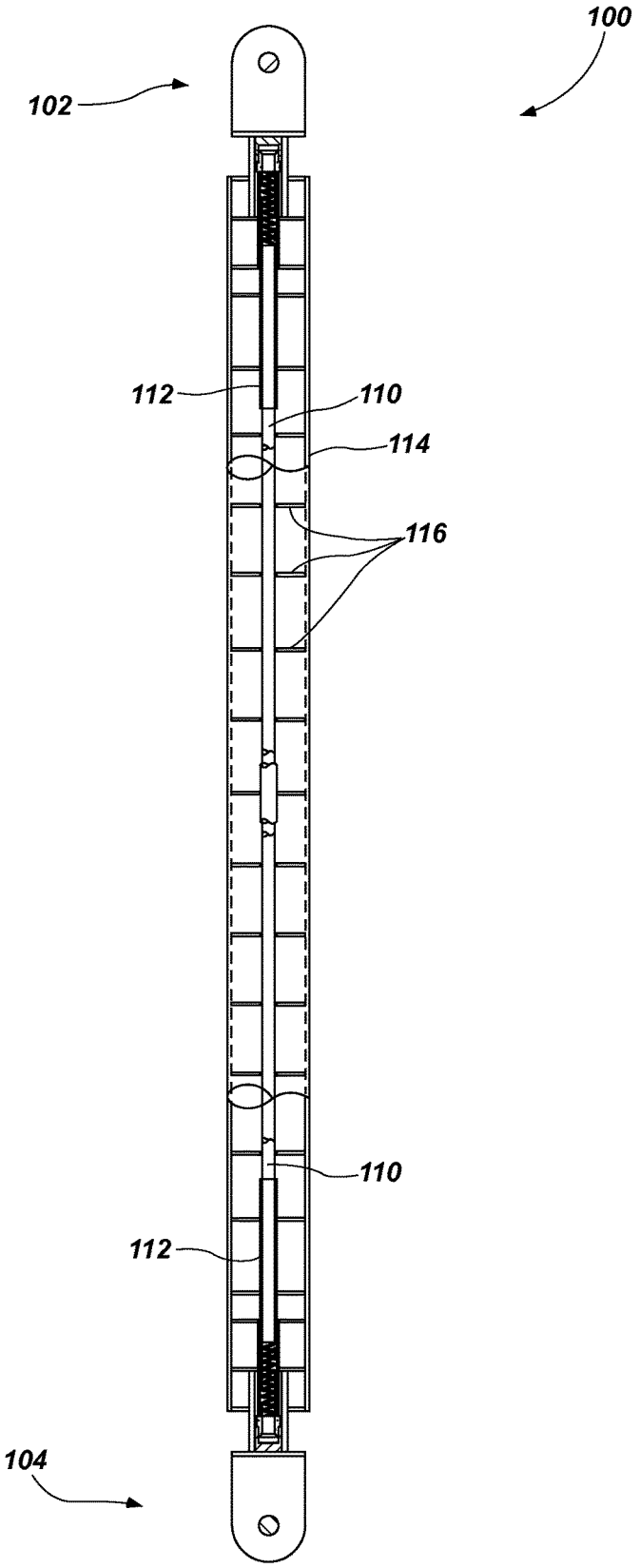
FIG. 2 is a partial cross-sectional view of a buckling restrained brace according to the embodiment of FIG. 1.

With reference now to FIG. 2, the buckling restrained brace 100 may include a core rod 110 extending axially through the buckling restrained brace 100, and each end of the core rod 110 may be anchored to a respective end plate assembly 102, 104. The core rod 110 may comprise a material capable of absorbing energy through plastic deformation of the material. As a non-limiting example, the core rod 110 may comprise a metal alloy with a relatively high toughness, such as steel. In other embodiments of the buckling restrained brace 100, the core rod 110 may comprise other metals, metal alloys, or non-metal materials. In the embodiment shown in FIG. 2, the core rod 110 may have a substantially circular cross-sectional shape. In other embodiments, the cross-sectional shape may be non-circular, e.g., rectangular, hexagonal, etc. The cross-sectional shape may be substantially constant along at least a portion of the length of the core rod 110.

The core rod 110 may be at least partially surrounded by a buckling restraining tube 112. During a seismic event or other application of force, the core rod 110 may be alternately stressed in tension and compression. The buckling restraining tube 112 may provide lateral support to the core rod 110 and prevent the core rod 110 from buckling under compressive forces. As a non-limiting example, the buckling restraining tube 112 may have a tubular shape with a cross-sectional interior shape similar to the cross-sectional shape of the core rod 110. An outside dimension (e.g., an outside diameter) of the core rod 110 and an inside dimension (e.g., an inside diameter) of the buckling restraining tube 112 may be sized to provide a gap between the core rod 110 and the buckling restraining tube 112. As a non-limiting example, the gap between the core rod 110 and the buckling restraining tube 112 may have a radius of between about 0.005 inch (0.127 mm) and about 0.05 inch (1.27 mm). For example, in one embodiment, the core rod 110 may have an outside diameter of about 0.75 inch (19.1 mm), and the buckling restraining tube 112 may have an inside diameter of about 0.78 inch (19.8 mm). Accordingly, the gap may be a concentric gap between the core rod 110 and the buckling restraining tube 112 with a radius of about 0.015 inch (about 0.38 mm). The actual dimensions of the core rod 110, buckling restraining tube 112, and the gap therebetween may be determined based at least in part on parameters and factors such as, e.g., the length of the buckling restrained brace 100, the size and construction of the building frame 108 (FIG. 1) in which the buckling restrained brace 100 is installed, the maximum force which the buckling restrained brace 100 is designed to withstand, etc. The gap may prevent binding between the core rod 110 and the buckling restraining tube 112 as the core rod 110 lengthens and shortens under tensile and compressive loads, respectively. In particular, the gap between the core rod 110 and the buckling restraining tube 112 may hinder or prevent binding under compressive loads, which may cause the core rod 110 to increase in diameter as it shortens due to Poisson's effect, and can result in stress concentrations and premature failure. As a non-limiting example, the buckling restraining tube 112 may comprise a metal alloy such as steel. In other embodiments, the buckling restraining tube 112 may comprise other materials such as composite materials (e.g., fiberglass or carbon fiber composites), polymer materials, or other materials.

The buckling restraining tube 112 may be disposed at least partially within an exterior support tube 114. The buckling restraining tube 112 may be incrementally (e.g., discontinuously) laterally supported within the exterior support tube 114. In other words, the bucking restraining tube 112 may be laterally supported along less than an entire length of the buckling restraining tube 112. For example, the buckling restraining tube 112 may be supported within the exterior support tube 114 by a plurality of spacers 116 disposed at intervals along the length of the buckling restraining tube 112. As a non-limiting example, the spacers 116 may be disposed at intervals of between about 5 inches (about 13 centimeters) and about 15 inches (about 38 centimeters) along a portion of the buckling restraining tube 112. In one specific embodiment, the spacers 116 may be disposed at intervals of between about 10 inches (about 25 centimeters) and about 12 inches (about 30 centimeters) along the length of the buckling restraining tube 112. The exterior support tube 114 may comprise a metal alloy such as steel, or may comprise materials such as composite materials, polymers, etc.

As a non-limiting example, each spacer of the plurality of spacers 116 may be a generally planar disk with an outside dimension (e.g., an outside diameter) substantially equal to an inside dimension (e.g., an inside diameter) of the exterior support tube 114, and a bore with an inside dimension (e.g., an inside diameter) substantially equal to an outside dimension (e.g., an outside diameter) of the buckling restraining tube 112. In other embodiments, the spacers 116 may have other configurations.

One or more spacers 116 of the plurality of spacers 116 may be affixed to the buckling restraining tube 112. For example, each spacer 116 may be welded (e.g., tack welded) to the buckling restraining tube 112. Each spacer 116 of the plurality of spacers 116 may or may not be affixed to the exterior support tube 114. For example, in some embodiments, the spacers 116 may be disposed within, but not attached to, the exterior support tube 114. Such a configuration may facilitate assembly of the buckling restrained brace 100, as described below.

Interaction between the buckling restraining tube 112, the plurality of spacers 116, and the exterior support tube 114 may support the buckling restraining tube 112 and prevent the buckling restraining tube 112 itself from bending or buckling when compressive loads are applied to the core rod 110 and transferred to the buckling restraining tube 112 through contact with the core rod 110. Stated differently, the exterior support tube 114 and the plurality of spacers 116 may increase the effective second moment of area (i.e., area moment of inertia) of the buckling restraining tube 112.

The volume defined between the buckling restraining tube 112 and the exterior support tube 114 may be at least substantially free of materials such as grout, cement, polymers, etc. In other words, the volume defined between the buckling restraining tube 112 and the exterior support tube 114 may be empty space, except for the volume occupied by the spacers 116 and other components described below.

Figure 3:
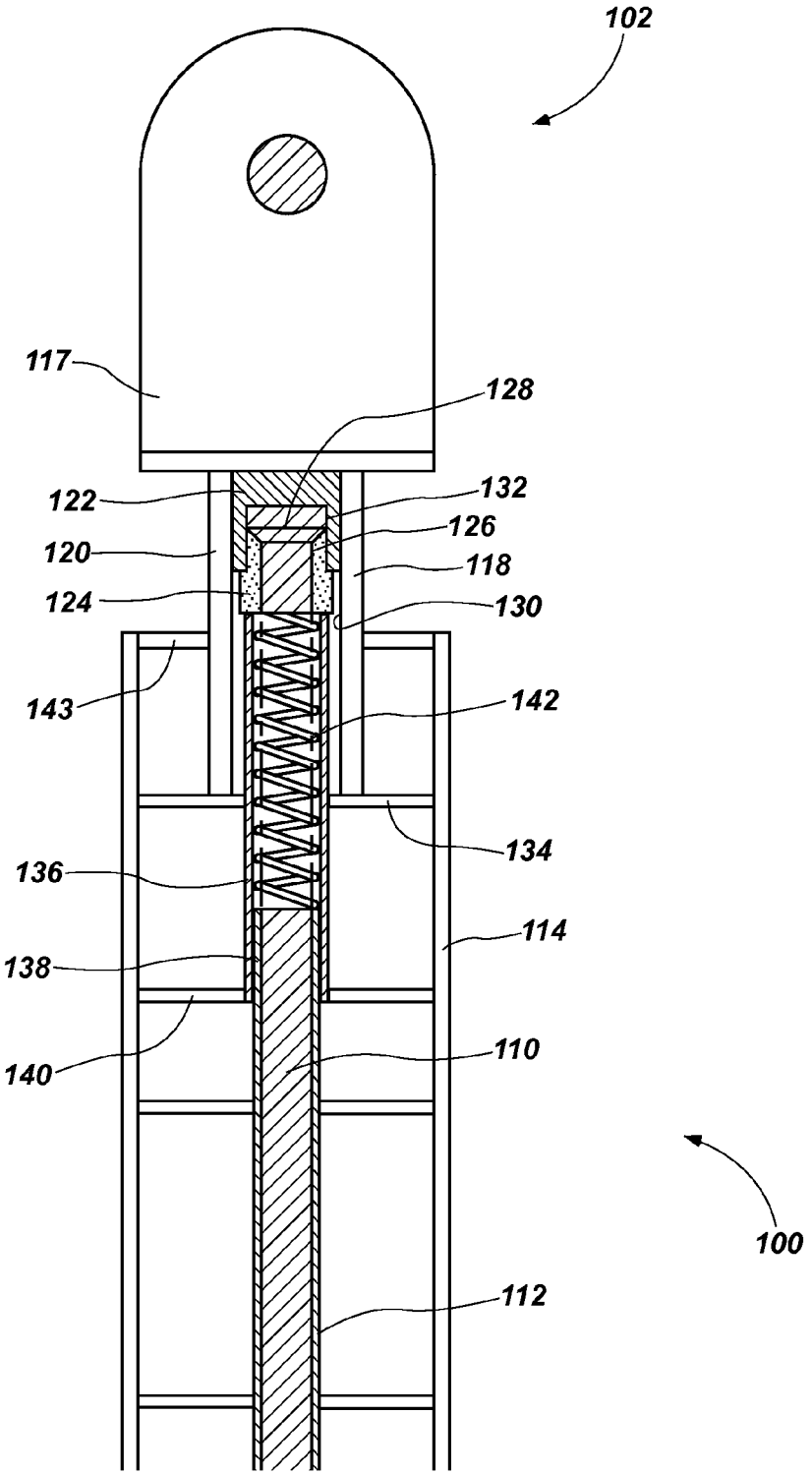
FIG. 3 is an enlarged partial cross-sectional view of a portion of a buckling restrained brace according to the embodiment of FIG. 1.

Referring now to FIG. 3, an enlarged cross-sectional view of a portion of the buckling restrained brace 100 with the end plate assembly 102 is shown. While only one end plate assembly 102 is illustrated in FIG. 3, both end plate assemblies 102, 104 (FIGS. 1 and 2) of the buckling restrained brace 100 may include similar or identical components, features, and functionality.

The end plate assembly 102 of the buckling restrained brace 100 may include a mounting flange 117 configured to be pinned or otherwise affixed to the building structure 108 (FIG. 1). The end plate assembly 102 of the buckling restrained brace 100 may include a coupler tube 118 with a coupler 120 disposed therein. The coupler 120 may comprise a base portion 122 and a retainer portion 124. The base portion 122 may include a threaded bore 126 into which the retainer portion 124 is threaded. The retainer portion 124 may retain an enlarged end 128 of the core rod 110 within the base portion 122 of the coupler 120. The enlarged end 128 of the core rod 110 may be formed by subjecting the core rod 110 to a forging process (e.g., swaging), or by another method.

In some embodiments, the buckling restrained brace 100 may be configured to have an adjustable length between the end plate assemblies 102, 104 (FIGS. 1 and 2). For example, in some embodiments, the coupler tube 118 may comprise internal threads 130, and at least a portion of the coupler 120 (e.g., a portion of an outside diameter of the base portion 122) may comprise complementary external threads 132. The thread direction of the internal threads 130 of the coupler tube 118 and the external threads 132 of the coupler 120 may be formed in opposite directions on each end of the buckling restrained brace 100. For example, if the coupler tube 118 and coupler 120 of the end plate assembly 102 include complementary right-handed threads, the coupler tube 118 and coupler 120 of the end plate assembly 104 may include complementary left-handed threads. With this configuration, the buckling restrained brace 100 may function similar to a turnbuckle. For example, when the end plate assemblies 102, 104 are held stationary (e.g., when pinned or otherwise connected to the building frame 108 (FIG. 1) or manually held in place) and the central portion of the buckling restrained brace 100 is rotated, the distance between the end plate assemblies 102, 104 is increased or decreased as the couplers 120 move within the respective coupler tubes 118. Thus, manufacturing tolerances of the buckling restrained brace 100 or inaccuracies in the construction of the building frame 108 can be compensated for by adjusting the length of the buckling restrained brace 100 between the end plate assemblies 102, 104.

A coupler tube spacer 134 may be affixed (e.g., welded) to the end of the coupler tube 118. The coupler tube spacer 134 may have an outside diameter substantially equal to the inside diameter of the exterior support tube 114. The coupler tube spacer 134 may be free to move axially relative to the exterior support tube 114. In other words, the coupler tube spacer 134 and the exterior support tube 114 may not be affixed to one another.

A sleeve member 136 may be affixed (e.g., welded) to the coupler 120. For example, as shown in FIG. 3, the sleeve member 136 may abut the retainer portion 124 of the coupler 120. The sleeve member 136 may be affixed (e.g., tack welded) to the retainer portion 124 of the coupler 120. An end portion 138 of the buckling restraining tube 112 may be disposed within and be free to move axially with respect to a portion of the sleeve member 136. A sleeve member spacer 140 may be affixed to an end of the sleeve member 136 remote from the coupler 120. The sleeve member spacer 140 may have an outside diameter substantially equal to an inside diameter of the exterior support tube 114. The sleeve member spacer 140 may be free to move axially within the exterior support tube 114. In other words, the sleeve member spacer 140 and the exterior support tube 114 may not be affixed to one another.

A spring 142 may be disposed within the sleeve member 136. The spring 142 may abut the coupler 120 and the buckling restraining tube 112. In other words, the spring 142 may be disposed axially between and adjacent to the coupler 120 and the buckling restraining tube 112. The spring 142 may have an inside diameter substantially equal to or slightly larger than the outside diameter of the core rod 110. For example, the spring 142 may have an inside diameter substantially equal to the inside diameter of the buckling restraining tube 112, and the spring 142 may have an outside diameter substantially equal to the outside diameter of the buckling restraining tube 112.

The spring 142 may have an uncompressed length greater than the length of the space between the buckling restraining tube 112 and the coupler 120. Stated differently, the spring 142 may be in a state of partial compression when installed between the buckling restraining tube 112 and the coupler 120 when the buckling restrained brace 100 (FIG. 2) is not subject to applied seismic force (e.g., a static, equilibrium position as installed in the building frame 108 (FIG. 1)). As shown in FIG. 3, the spring 142 may be a coil spring. As additional non-limiting examples, the spring 142 may comprise, e.g., a stack of Bellville springs, or other spring configurations. As described in further detail below, the spring 142 may be configured to provide substantially continuous lateral support to the core rod 110 by varying in length as components of the buckling restrained brace 100 undergo relative axial movement during application of force to the buckling restrained brace 100. The spring 142 may not necessarily apply axial spring force to components of the buckling restrained brace 100 beyond the force required to maintain the spring 142 in a centered position between, and in contact with, the coupler 120 and the buckling restraining tube 112.

An end cap spacer 143 may be affixed (e.g., welded) within the end of the exterior support tube 114. The end cap spacer 143 may have an outside dimension (e.g., an outside diameter) substantially equal to an inside dimension of the exterior support tube 114. The end cap spacer 143 may have an opening with an inside dimension (e.g., an inside diameter) substantially equal to or slightly larger than an outside diameter of the coupler tube 118. The end cap spacer 143 may not be attached to the coupler tube 118. In other words, the end cap spacer 143 may be free to move with respect to the coupler tube 118.

In operation (e.g., when the buckling restrained brace 100 is subject to cyclic forces transmitted through the building frame 108 (FIG. 1) resulting in compressive and/or tensile strain of the core rod 110), the core rod 110 may plastically deform under tension and compression. During such deformation, a portion of the core rod 110 may leave the buckling restraining tube 112 as the core rod 110 lengthens under tension and reenter the buckling restraining tube 112 as the core rod 110 shortens under compression. Stated another way, a greater fraction of the total length of the core rod 110 may become unsupported by the buckling restraining tube 112 as the core rod 110 lengthens under tension. The spring 142 may guide the unsupported length of the core rod 110 back into the buckling restraining tube 112 as the core rod 110 shortens under compressive force, and may prevent buckling of the portion of the core rod 110 disposed outside of the buckling restraining tube 112. In other words, the spring 142 may provide lateral support to the portion of the core rod 110 not laterally supported by the buckling restraining tube 112. The spring 142 may also prevent the core rod 110 from binding against the end of the buckling restraining tube 112 as compressive forces urge the unsupported length of the core rod 110 back into the buckling restraining tube 112.

As the total length of the core rod 110 lengthens and shortens during application of cyclic tensile and compressive forces, the end plate assemblies 102, 104 (FIGS. 1 and 2) may accommodate the length change of the core rod 110 by moving relative to the exterior support tube 114 and the buckling restraining tube 112. For example, the mounting flange 117, the coupler tube 118, the coupler 120, the sleeve member 136, the sleeve member spacer 140, and the coupler tube spacer 134 may move axially as an assembly with respect to the exterior support tube 114 and the buckling restraining tube 112. The spring 142 may lengthen and shorten in response to the movement of the end plate assemblies 102, 104 relative to the exterior support tube 114 and the buckling restraining tube 112. In this manner, the spring 142 and the buckling restraining tube 112 provide the core rod 110 with substantially continuous lateral support, and the spring 142 prevents the core rod 110 from buckling or binding at the open end of the buckling restraining tube 112.

In some embodiments, the exterior support tube 114, the buckling restraining tube 112, and the core rod 110 may be joined together and attached to one another at a centerline (or at least proximate a centerline) of the buckling restrained brace 100. For example, referring now to FIG. 4, a central spacer 146 located near a centerline 144 of the buckling restrained brace 100 (FIG. 2) may surround and be affixed (e.g., welded) to the core rod 110. The buckling restraining tube 112 (FIGS. 2 and 3) may comprise a first segment 112' and a second segment 112", and the first and second segments 112', 112' of the buckling restraining tube 112 may abut and be affixed (e.g., welded) to the central spacer 146. The exterior support tube 114 may be affixed to the central spacer 146. For example, the exterior support tube 114 may be spot-welded to the central spacer 146 through one or more plug weld holes 148 formed in the exterior support tube 114 by, e.g., drilling.

In some embodiments, assembly of the buckling restrained brace 100 may include assembling internal components of the buckling restrained brace 100 outside of the exterior support tube 114 to create an assembly of internal components, inserting the assembly of internal components within the exterior support tube 114, and affixing the exterior support tube 114 to the assembly of internal components.

For example, the internal components of the buckling restrained brace 100 may be assembled as follows. One end of a portion of material stock used to form the core rod 110 may be swaged to form one enlarged end 128 (FIG. 3). The enlarged end 128 may be affixed within a coupler 120 (FIG. 3) by threading a coupler base portion 122 and a coupler retainer portion 124 together over the enlarged end 128 of the core rod 110. Assembly may then proceed from the unswaged end of the material stock. For example, the springs 142 (FIG. 3), the buckling restraining tube segments 112' and 112" (FIG. 4), the central spacer 146 (FIG. 4), and the sleeve members 136 (FIG. 3) may be positioned on the core rod 110 by placing them in the appropriate order over the unswaged end of the core rod 110 and sliding each to the correct position. The spacers 116 (FIG. 2) and sleeve member spacers 140 may be welded to the buckling restraining tube segments 112' and 112" and sleeve members 136, respectively. A coupler retainer portion 124 may be placed over the unswaged end of the core rod 110, and the unswaged end may be swaged. A coupler base portion 122 may be threaded together with the coupler retainer portion 124 so that the newly swaged end of the core rod 110 is affixed within a coupler 120. Each coupler 120 may be threaded into a respective coupler tube 118, and coupler tube spacers 134 (FIG. 3) may be welded to each coupler tube 118 to complete the assembly of internal components.

Figure 4:
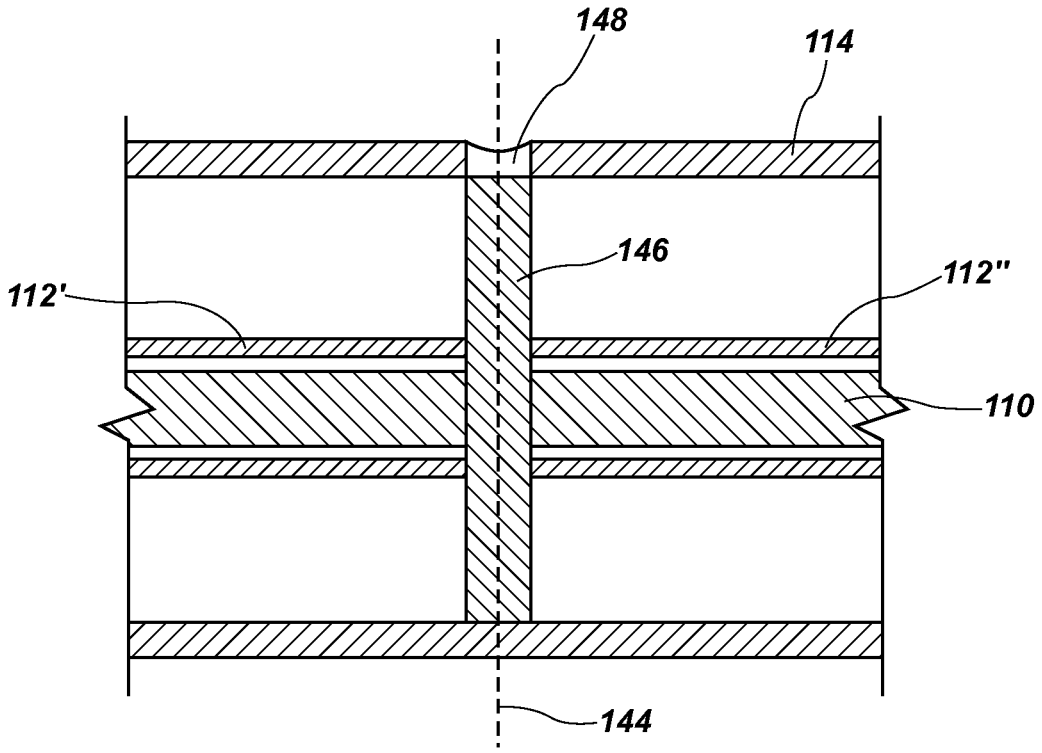
FIG. 4 is an enlarged cross-sectional view of another portion of a buckling restrained brace according to the embodiment of FIG. 1.

The assembly of internal components as described above may be inserted within the exterior support tube 114 (FIGS. 2, 3, and 4). The exterior support tube 114 may be affixed to the assembly of internal components by welding the exterior support tube 114 to the central spacer 146 through one or more plug weld holes 148 as described in connection with FIG. 4. End cap spacers 143 (FIG. 3) may be welded within the ends of the exterior support tube 114. Finally, mounting flanges 117 (FIG. 3) may be welded to each coupler tube 118.

Additional non-limiting example embodiments of the disclosure are set forth below.

Embodiment 1

A buckling restrained brace, comprising: a core rod; a buckling restraining tube concentrically surrounding at least a portion of a length of the core rod and configured to provide lateral support to the core rod to hinder buckling of the core rod upon compressive loading of the core rod; an exterior support tube disposed concentrically surrounding at least a portion of a length of the buckling restraining tube; and a plurality of spacers disposed between the buckling restraining tube and the exterior support tube at intervals along a length of the buckling restraining tube, the plurality of spacers locating and supporting the buckling restraining tube within the exterior support tube.

Embodiment 2

The buckling restrained brace of Embodiment 1, further comprising at least one end plate assembly, and wherein the core rod comprises an enlarged end affixed to the at least one end plate assembly of the buckling restrained brace.

Embodiment 3

The buckling restrained brace of Embodiment 2, wherein the at least one end plate assembly comprises a coupler, and wherein the enlarged end of the core rod is disposed within the coupler.

Embodiment 4

The buckling restrained brace of Embodiment 3, wherein the at least one end plate assembly further comprises a coupler tube with a threaded interior surface, and wherein the coupler comprises a threaded exterior surface engaged with the threaded interior surface of the coupler tube of the at least one end plate assembly.

Embodiment 5

The buckling restrained brace of Embodiment 4, wherein the buckling restrained brace comprises a first end and a second end, the first end comprising a first coupler and a first coupler tube having complementary threads with a first thread direction, the second end comprising a second coupler and a second coupler tube having complementary threads with a second thread direction opposite the first thread direction.

Embodiment 6

The buckling restrained brace of any one of Embodiments 1 through 5, wherein the plurality of spacers comprises disks, each having an outside diameter substantially matching an inside diameter of the exterior support tube.

Embodiment 7

The buckling restrained brace of any one of Embodiments 1 through 6, wherein a majority of a volume defined between the exterior support tube and the buckling restraining tube comprises air or gas and is free of solid material.

Embodiment 8

The buckling restrained brace of any one of Embodiments 1 through 7, wherein no solid material other than the plurality of spacers is disposed between the exterior support tube and the buckling restraining tube.

Embodiment 9

The buckling restrained brace of any one of Embodiments 1 through 8, wherein the core rod is separated from an inside wall of the buckling restraining tube by a gap of between about 0.005 inch (0.127 mm) to about 0.05 inch (1.27 mm).

Embodiment 10

The buckling restrained brace of any one of Embodiments 1 through 9, wherein the plurality of spacers is disposed at longitudinal intervals of between about 5 inches (about 13 centimeters) and about 15 inches (about 38 centimeters) along a length of the buckling restrained brace.

Embodiment 11

A buckling restrained brace, comprising: a core rod; an end plate assembly attached to an end of the core rod; a buckling restraining tube concentrically surrounding at least a portion of a length of the core rod and configured to provide lateral support to the core rod to hinder buckling of the core rod upon compressive loading of the core rod; a sleeve member concentrically surrounding an end of the buckling restraining tube, the sleeve member affixed to the end plate assembly; and a spring disposed within the sleeve member, the spring located between and abutting the end of the buckling restraining tube and the end plate assembly of the buckling restrained brace.

Embodiment 12

The buckling restrained brace of Embodiment 11, wherein the buckling restraining tube has an outside diameter and an inside diameter, wherein the spring has an outside diameter and an inside diameter, and wherein the outside diameter and the inside diameter of the buckling restraining tube are substantially equal to the outside diameter and the inside diameter of the spring.

Embodiment 13

The buckling restrained brace of Embodiment 11 or Embodiment 12, wherein the buckling restraining tube comprises a wall thickness, and wherein the spring is a coil spring comprising a wire size with a diameter substantially equal to the wall thickness of the buckling restraining tube.

Embodiment 14

A buckling restrained brace, comprising: a core rod; an end plate assembly attached to an end of the core rod; a buckling restraining tube concentrically surrounding a portion of a length of the core rod and configured to provide lateral support to the core rod to hinder buckling of the core rod upon compressive loading of the core rod; an exterior support tube concentrically surrounding at least a portion of a length of the buckling restraining tube; and a sleeve member disposed around a portion of the buckling restraining tube, the sleeve member affixed to the end plate assembly, wherein the sleeve member is permitted to move axially relative to the exterior support tube and the buckling restraining tube when the core rod plastically deforms in response to an applied force.

Embodiment 15

The buckling restrained brace of Embodiment 14, wherein the end plate assembly further comprises a coupler tube, and wherein the sleeve member is at least partially disposed within the coupler tube of the end plate assembly.

Embodiment 16

The buckling restrained brace of Embodiment 15, further comprising a coupler disposed within the coupler tube, wherein the end of the core rod is enlarged, and wherein the coupler is configured to retain the enlarged end of the core rod to the end plate assembly.

Embodiment 17

The buckling restrained brace of Embodiment 15 or Embodiment 16, further comprising a coupler tube spacer affixed to an end of the coupler tube and having an outside dimension substantially matching an inside dimension of the exterior support tube.

Embodiment 18

The buckling restrained brace of Embodiment 17, wherein the coupler tube spacer is permitted to move axially within the exterior support tube.

Embodiment 19

The buckling restrained brace of any one of Embodiments 14 through 18, further comprising a sleeve member spacer affixed to an end of the sleeve member, the sleeve member spacer having an outside dimension substantially matching an inside dimension of the exterior support tube.

Embodiment 20

The buckling restrained brace of Embodiment 19, wherein the sleeve member spacer is permitted to move axially within the exterior support tube.

Embodiment 21

A method of assembling a buckling restrained brace, the method comprising: providing a core rod with an enlarged first end and a second, unenlarged end; affixing the enlarged first end of the core rod within a first coupler; placing a first spring over the second, unenlarged end of the core rod so that the first spring circumferentially surrounds the core rod; abutting the first spring against the first coupler; placing a buckling restraining tube over the second, unenlarged end of the core rod so that the buckling restraining tube circumferentially surrounds the core rod; abutting the buckling restraining tube against the first spring; placing a second spring over the second, unenlarged end of the core rod so that the second spring circumferentially surrounds the core rod; abutting the second spring against the buckling restraining tube; enlarging the second end of the core rod; and affixing the second enlarged end within a second coupler, the second coupler abutting the second spring.

Embodiment 22

The method of Embodiment 21, further comprising affixing a plurality of spacers to the buckling restraining tube at longitudinal intervals along the length of the buckling restraining tube.

Embodiment 23

The method of Embodiment 21 or Embodiment 22, wherein placing a buckling restraining tube over the second, unenlarged end of the core rod so that the buckling restraining tube circumferentially surrounds the core rod comprises placing a first buckling restraining tube segment over the second, unenlarged end of the core rod so that the first buckling restraining tube segment circumferentially surrounds the core rod, placing a central spacer over the second, unenlarged end of the core rod so that the central spacer circumferentially surrounds the core rod and the central spacer is at least substantially aligned with a longitudinal centerline of the core rod and abuts the first buckling restraining tube segment, and placing a second buckling restraining tube segment over the second, unenlarged end of the core rod so that the second buckling restraining tube segment circumferentially surrounds the core rod and abuts the central spacer.

Embodiment 24

The method of Embodiment 23, further comprising disposing at least a portion of the core rod, the first and second buckling restraining tube segments, the central spacer, and the plurality of spacers within an exterior support tube.

Embodiment 25

The method of Embodiment 24, further comprising affixing the central spacer to the exterior support tube.

Embodiment 26

The method of any one of Embodiments 21 through 25, further comprising affixing the first coupler and the second coupler within a first coupler tube and a second coupler tube, respectively.

Embodiment 27

The method of Embodiment 26, further comprising affixing a first end plate assembly and a second end plate assembly to the first coupler tube and the second coupler tube, respectively.

Embodiment 28

A method of installing a buckling restrained brace within a building frame, the method comprising: adjusting a length of the buckling restrained brace by rotating a central portion of the buckling restrained brace relative to a first end plate assembly and a second end plate assembly of the buckling restrained brace; affixing the first end plate assembly to a first mounting location of the building frame, and affixing the second end plate assembly to a second mounting location of the building frame.

Although the foregoing description and accompanying drawings contain many specifics, these are not to be construed as limiting the scope of the disclosure, but merely as describing certain embodiments. Similarly, other embodiments may be devised, which do not depart from the spirit or scope of the disclosure. For example, features described herein with reference to one embodiment also may be provided in others of the embodiments described herein. The scope of the invention is, therefore, indicated and limited only by the appended claims and their legal equivalents. All additions, deletions, and modifications to the disclosed embodiments, which fall within the meaning and scope of the claims, are encompassed by the present disclosure.

What is claimed is:

1. A buckling restrained brace for connection between structural members of a building and configured to absorb transient loads applied to the building, the buckling restrained brace comprising:

a core rod;

an end plate assembly attached to an end of the core rod, the end plate assembly being located at a longitudinal end of the buckling restrained brace;

a buckling restraining tube concentrically surrounding at least a majority of a longitudinal length of the core rod and configured to provide lateral support to the core rod to hinder buckling of the core rod upon compressive loading of the core rod;

a sleeve member concentrically surrounding an end of the buckling restraining tube, the sleeve member affixed to the end plate assembly; and a spring disposed within the sleeve member, the spring located laterally between the core rod and the sleeve member of the end plate assembly and longitudinal ends of the spring abutting the end of the buckling restraining tube and the end plate assembly of the buckling restrained brace, wherein the sleeve member extends longitudinally from proximate the core rod, along the spring, to one of the longitudinal ends of the spring proximate the end plate assembly.

2. The buckling restrained brace of claim 1, wherein the buckling restraining tube has an outside diameter and an inside diameter, wherein the spring has an outside diameter and an inside diameter, and wherein the outside diameter and the inside diameter of the buckling restraining tube are substantially equal to the outside diameter and the inside diameter of the spring.

3. The buckling restrained brace of claim 2, wherein the buckling restraining tube comprises a wall thickness, and wherein the spring is a coil spring comprising a wire size with a diameter substantially equal to the wall thickness of the buckling restraining tube.

4. A buckling restrained brace, comprising:

a core rod;

an end plate assembly attached to an end of the core rod, the end plate assembly being located at a longitudinal end of the buckling restrained brace;

a buckling restraining tube concentrically surrounding a majority of a longitudinal length of the core rod and configured to provide lateral support to the core rod to hinder buckling of the core rod upon compressive loading of the core rod;

an exterior support tube concentrically surrounding at least a portion of a length of the buckling restraining tube;

a sleeve member disposed around a portion of the buckling restraining tube, the sleeve member affixed to the end plate assembly, wherein the sleeve member is permitted to move axially relative to the exterior support tube and the buckling restraining tube when the core rod plastically deforms in response to an applied force; and a spring located laterally between the core rod and the sleeve member of the end plate assembly and longitudinally between, and in contact with, an end of the buckling restraining tube and a portion of the end plate assembly.

5. The buckling restrained brace of claim 4, wherein the end plate assembly further comprises a coupler tube, and wherein the sleeve member is at least partially disposed within the coupler tube of the end plate assembly.

6. The buckling restrained brace of claim 5, further comprising a coupler disposed within the coupler tube, wherein the end of the core rod is enlarged, and wherein the coupler is configured to retain the enlarged end of the core rod to the end plate assembly.

7. The buckling restrained brace of claim 5, further comprising a coupler tube spacer affixed to an end of the coupler tube and having an outside dimension substantially matching an inside dimension of the exterior support tube.

8. The buckling restrained brace of claim 7, wherein the coupler tube spacer is permitted to move axially within the exterior support tube.

9. The buckling restrained brace of claim 4, further comprising a sleeve member spacer affixed to an end of the sleeve member, the sleeve member spacer having an outside dimension substantially matching an inside dimension of the exterior support tube.

10. The buckling restrained brace of claim 9, wherein the sleeve member spacer is permitted to move axially within the exterior support tube.

11. A buckling restrained brace, comprising:

a core rod;

an end plate assembly attached to an end of the core rod, the end plate assembly being located at a longitudinal end of the buckling restrained brace;

a buckling restraining tube concentrically surrounding at least a majority of a longitudinal length of the core rod and configured to provide lateral support to the core rod to hinder buckling of the core rod upon compressive loading of the core rod;

an exterior support tube disposed concentrically surrounding at least a portion of a length of the buckling restraining tube;

a plurality of spacers disposed between the buckling restraining tube and the exterior support tube at intervals along a length of the buckling restraining tube, the plurality of spacers locating and supporting the buckling restraining tube within the exterior support tube;

a sleeve member concentrically surrounding an end of the buckling restraining tube, the sleeve member affixed to the end plate assembly; and a spring located laterally between the core rod and the sleeve member of the end plate assembly and longitudinally between, and in contact with, an end of the buckling restraining tube and a portion of the end plate assembly.

12. The buckling restrained brace of claim 11, wherein the core rod comprises an enlarged end affixed to the end plate assembly of the buckling restrained brace.

13. The buckling restrained brace of claim 12, wherein the end plate assembly comprises a coupler, and wherein the enlarged end of the core rod is disposed within the coupler.

14. The buckling restrained brace of claim 13, wherein the end plate assembly further comprises a coupler tube with a threaded interior surface, and wherein the coupler comprises a threaded exterior surface engaged with the threaded interior surface of the coupler tube of the end plate assembly, the coupler tube extending longitudinally from proximate an end of the spring beyond the end of the spring and an end of the core rod when the spring is in an extended state.

15. The buckling restrained brace of claim 14, wherein the coupler comprises a first coupler and the coupler tube comprises a first coupler tube, and wherein the buckling restrained brace comprises a first end and a second end, the first end comprising the first coupler and the first coupler tube having complementary threads with a first thread direction, the second end comprising a second coupler and a second coupler tube having complementary threads with a second thread direction opposite the first thread direction.

16. The buckling restrained brace of claim 11, wherein the plurality of spacers comprises disks, each having an outside diameter substantially matching an inside diameter of the exterior support tube.

17. The buckling restrained brace of claim 11, wherein a majority of a volume defined between the exterior support tube and the buckling restraining tube comprises air or gas and is free of solid material.

18. The buckling restrained brace of claim 11, wherein no solid material other than the plurality of spacers is disposed between the exterior support tube and the buckling restraining tube.

19. The buckling restrained brace of claim 11, wherein the core rod is separated from an inside wall of the buckling restraining tube by a gap of between 0.005 inch (0.127 mm) to 0.05 inch (1.27 mm).

20. The buckling restrained brace of claim 11, wherein the plurality of spacers is disposed at longitudinal intervals of between 5 inches (13 centimeters) and 15 inches (38 centimeters) along a length of the buckling restrained brace.

* * * * *